US008624529B2

(12) United States Patent
Neuman

(10) Patent No.: US 8,624,529 B2
(45) Date of Patent: Jan. 7, 2014

(54) METHOD FOR THE AUTOMATED CONTROL OF A SOLAR PROTECTION INSTALLATION

(75) Inventor: Serge Neuman, Seynod (FR)

(73) Assignee: Somfy SAS, Cluses (FR)

( * ) Notice: Subject to any disclaimer, the term of this patent is extended or adjusted under 35 U.S.C. 154(b) by 598 days.

(21) Appl. No.: 12/743,160

(22) PCT Filed: Nov. 14, 2008

(86) PCT No.: PCT/IB2008/054781
§ 371 (c)(1),
(2), (4) Date: Jul. 9, 2010

(87) PCT Pub. No.: WO2009/063428
PCT Pub. Date: May 22, 2009

(65) Prior Publication Data

US 2011/0251720 A1 Oct. 13, 2011

(30) Foreign Application Priority Data

Nov. 16, 2007 (FR) ..... 07 08050

(51) Int. Cl.

| | |
|---|---|
| ***F04D 15/00*** | (2006.01) |
| ***G05D 23/00*** | (2006.01) |
| ***G08B 13/08*** | (2006.01) |
| ***E06B 9/30*** | (2006.01) |
| ***E06B 9/00*** | (2006.01) |

(52) U.S. Cl.
USPC ..... 318/3; 700/275; 160/10; 160/170; 160/236

(58) Field of Classification Search
USPC ..... 318/3; 700/275; 160/10, 170, 236
See application file for complete search history.

(56) References Cited

U.S. PATENT DOCUMENTS

| | | | | |
|---|---|---|---|---|
| 3,646,985 | A * | 3/1972 | Klann | 160/168.1 R |
| 4,398,587 | A | 8/1983 | Boyd | |
| 4,486,073 | A | 12/1984 | Boyd | |
| 4,773,733 | A * | 9/1988 | Murphy et al. | 359/593 |
| 5,142,133 | A | 8/1992 | Kern et al. | |
| 2004/0163774 | A1 * | 8/2004 | Nien et al. | 160/168.1 P |
| 2005/0056382 | A1 * | 3/2005 | Khajavi | 160/167 R |
| 2007/0012407 | A1 * | 1/2007 | Nien et al. | 160/170 |
| 2008/0041533 | A1 * | 2/2008 | Ziegler | 160/10 |

FOREIGN PATENT DOCUMENTS

| | | | |
|---|---|---|---|
| DE | 4239003 | A | 5/1993 |
| DE | 10158620 | A | 7/2003 |
| FR | 2 772 069 | A | 6/1999 |
| WO | WO 01/00958 | A | 1/2001 |

* cited by examiner

*Primary Examiner* — Eduardo Colon Santana
*Assistant Examiner* — Gabriel Agared
(74) *Attorney, Agent, or Firm* — Frommer Lawrence & Haug LLP; Ronald R. Santucci

(57) ABSTRACT

An automated control of a solar protection installation (INST), includes reflecting slats (B1, B2, B3) having parallel longitudinal axes, the slats having a face (F) provided with teeth (D) which flanks (F1), exposable to the light rays and called "useful" flanks, lie in parallel planes (P1, P2, P3, P4). The main direction of incidence (ASUN1; ASUN2) of the light rays on the slats is determined (CPU, CLK, ASUN) and a motor (MOT) is provided for tilting the slats at least substantially about their longitudinal axis. The slats are automatically tilted to orient the planes of the useful flanks depending on the main direction of incidence of the light rays.

11 Claims, 3 Drawing Sheets

METHOD FOR THE AUTOMATED CONTROL OF A SOLAR PROTECTION INSTALLATION

This application is a 371 of PCT/IB2008/054781 filed on Nov. 14, 2008 published on May 22, 2009 under publication number WO 2009/063428 A and claims priority benefits to French application number 07 08050 filed Nov. 16, 2007, the entire disclosure of which is incorporated herein by reference.

BACKGROUND OF THE INVENTION

The invention relates to the field of tiltable solar protection devices, particularly interior venetian blinds, comprising a plurality of horizontal slats arranged parallel to one another and a mechanism for varying the tilting angle of these slats. Conventional venetian blind slats generally have smooth surfaces and a curved section, the latter providing the stiffness necessary for the holding and tilting of the slats (the slats being supported only by ladder strings at their ends).

DESCRIPTION OF THE PRIOR ART

There is extensive prior art on various shapes of solar protection devices that are either tiltable or fixed. In the second case, structures formed on the slats provide the function of protecting against the dazzling incident solar radiation, without modifying the tilt of the blades.

In particular, patents FR 2 772 069 and EP 1 212 508 describe so-called "retroreflection" slats for reflecting the incident rays striking these slats toward the exterior and not toward the interior, as is the case for conventional venetian blinds in which the slat surfaces are smooth. The feature of these two patents is that the angles $\alpha_1$ to the horizontal of the surfaces of what are called "useful teeth" (located on the window side and therefore exposed to the solar rays) are varied over the width of the slat.

In patent FR 2 772 069, the angles $\alpha_1$ in the zone close to the point of incidence of light rays on a slat are more obtuse than in the zones of the slat that are further away. This variation in the angles is obtained, from teeth formed on the planar slat with parallel surfaces (at equal angles $\alpha_1$), by curving the slat in a convex manner. The angles $\alpha_2$ of the opposed teeth surfaces, located in the shadow, are moreover larger than the angles $\alpha_1$ of the useful teeth surfaces, thus forming what are called "factory roof" teeth. These teeth are formed on an upper surface of the slats.

In patent EP 1 212 508, the tilt angles $\beta_1$ of the useful teeth surfaces are smaller in the zone of incidence of the light rays on the slat than in the zones further away from this zone of incidence. This configuration is achieved using a planar slat with teeth having parallel surfaces (at equal angles $\beta_1$) by curving the slat in a concave manner. The teeth are also formed on the upper surfaces of the slats.

These configurations thus ensure that the sun rays are reflected in the direction of incidence or so that they converge on the end of the upper slat, whatever the angle of incidence.

These slats have the advantage of reflecting most of the light rays toward the exterior, while still maintaining a position close to the horizontal, enabling good visibility to the outside. Moreover, they allow adaptation to the various incident ray situations, the high-angle rays from the sun in summer being mostly reflected, so as to prevent thermal influx into the room, whereas the more grazing rays of the sun in winter may be transmitted into the interior of the room. Said slats are most particularly beneficial in fixed installations, less so in the context of dynamic slat tilt adjustment.

U.S. Pat. Nos. 4,486,073 and 4,398,587 also present particular shapes of slat surfaces for venetian blinds. Apart from the specific shapes of straight teeth supported by planar slats, two curved slat shapes are presented. In one, the slat is produced such that the angles included between the peaks and troughs of the pleats are 90°, but the widths of the reflecting surfaces increase from the center toward the edges so as to follow a convex shape.

Another example is presented in which, on the contrary, the angle between the reflecting surfaces is 90° only at the center. The shape followed is concave, but the surfaces of the teeth are then no longer parallel.

These structures may also be formed on the lower surface of a transparent slat, so that they are reached by incident solar radiation passing through this transparent material.

Although the above patents seek to simplify these venetian blinds, their production remains difficult, especially in the case of curved shapes, which are the shapes at rest. In addition, these documents do not provide such structures, just like the previously mentioned patents, for use in a dynamically tiltable blind.

It is also known, in the presence of direct sunlight, to tilt the mean plane of the slats of conventional blinds so that it is approximately perpendicular to the sun rays. In certain cases, as in patent U.S. Pat. No. 5,142,133, an electronic device servocontrols the position of the slats so as to obtain the perpendicular situation.

However, this method of regulation is not necessarily suitable for slats having a retroreflecting effect, although dynamic adjustment of the slats allows better use of the solar protection installation by offering possible manual control and manual and/or automatic adjustment options for all situations. A similar device is also disclosed in document DE 101 58 620.

Also disclosed, in document DE 42 39 003, is a blind, comprising tiltable reflecting slats provided with teeth in order to prevent solar radiation from entering a room and to control the brightness therein.

SUMMARY OF THE INVENTION

The object of the invention is to provide a specific slat structure which, within the context of dynamic adjustment, ensures optimum protection, without however excessively darkening the room or while maintaining maximum visibility to the outside. In addition, the invention proposes to simplify the production of slats for retroreflective venetian blinds, in an alternative manner to that of existing slats.

According to the invention, the method of control is defined by claim 1.

Various embodiments are defined by dependent claims 2 to 4.

According to the invention, a solar protection installation is defined by claim 5.

Various embodiments are defined by dependent claims 6 to 10.

DESCRIPTION OF THE DRAWINGS

The appended drawing shows, by way of example, one embodiment of a solar protection installation according to the invention and one way of carrying out a method of controlling such an installation.

DESCRIPTION OF THE PREFERRED EMBODIMENT(S)

Figure 1:
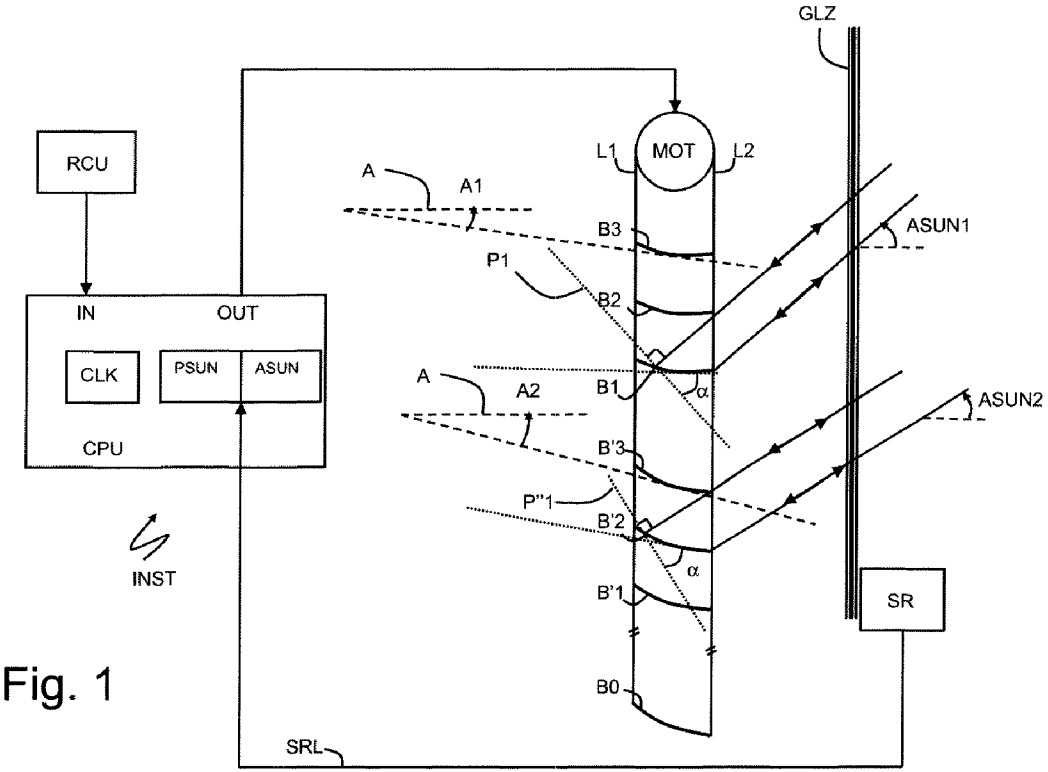
FIG. 1 is a diagram of one embodiment of a solar protection installation according to the invention.

FIG. 1 shows an installation INST according to the invention. The installation INST comprises a solar protection screen SCR consisting of horizontal slats B1, B2, B3 (or B'1, B'2, B'3) guided for their orientation by ladder strings L1 and L2 that are connected to a motor MOT.

The screen SCR is placed behind wall façade glazing GLZ, in a room inside a building. Alternatively, the screen is placed in front of the glazing, on the outside of the building.

The slats are of the retroreflective or catadioptric type. Ideally, any ray incident on a slat is reflected in the direction of incidence. The behavior of a slat will be called here retroreflective if this property is verified overall, i.e. if, for at least most of the instant rays and points of incidence, any reflected ray is emitted in a cone of small opening angle (for example 30°) that includes the incident direction. The behavior may be retroreflective only in a certain range of relative angles of inclination of the incident rays to the slats.

FIG. 1 shows, in part, the screen in two different orientations, obtained through the action of the motor MOT, for different angles of incidence ASUN1 and ASUN2 of the direct solar radiation, so as to show the effects of the automatic orientation of the slats on the reflection.

Right at the bottom of the screen, a slat B0 is shown with arbitrary tilt.

The top part of the screen shows three slats B1-B3 with a first tilt angle A1. The tilt angle is shown as the acute angle measured algebraically between a reference plane, tangential to the slats, and a horizontal plane A. Because of the curvature of the slats, the reference plane may be taken as the plane containing the points of attachment of the slats to the ladder support strings. The angular deviation resulting from choosing one reference plane rather than another corresponds to a constant shift, which is not involved in the control method.

The bottom part of the screen then shows three slats B'1-B'3, with a second particular tilt angle A2.

The three slats B'1-B'3 are for example the previous slats B1-B3, but shown in a different angular position.

The direct solar radiation strikes the upper faces Fa of the slats or upper face portions of the slats.

Another slat B0 is shown that acts as reference slat.

Figure 2:
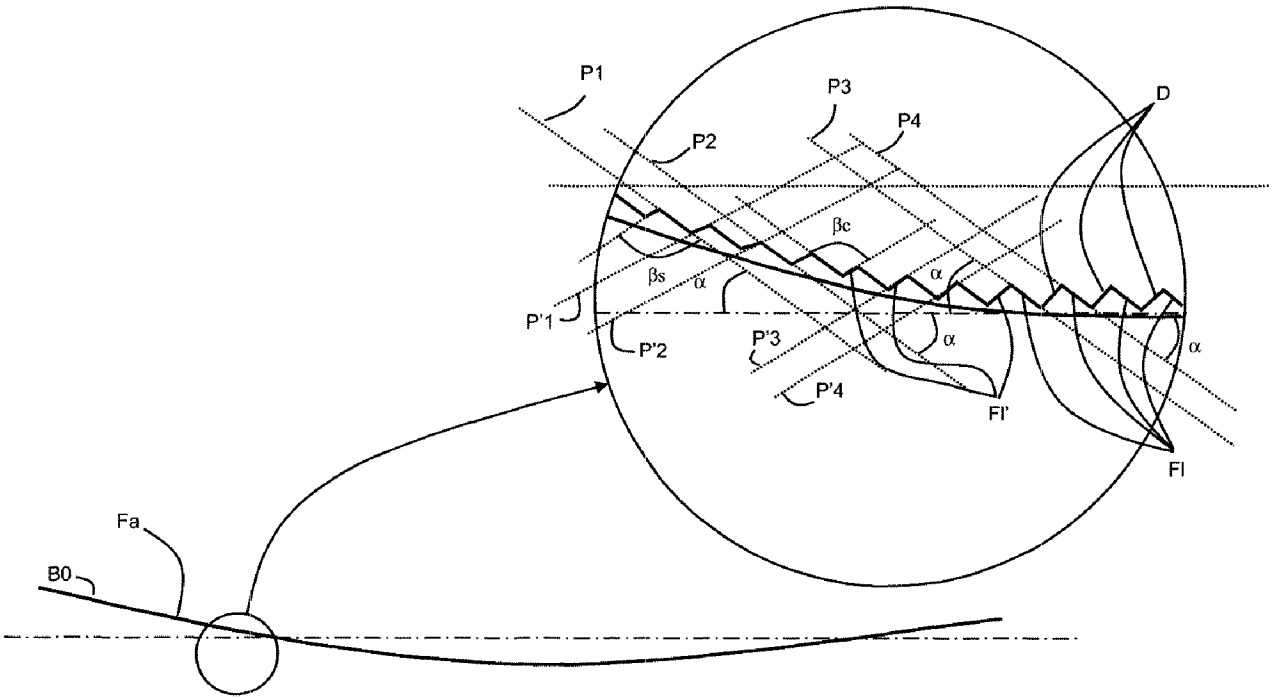
FIG. 2 is a diagram showing in detail the structure of the upper faces of the slats of the solar protection installation.

According to the invention, the slats are provided with teeth D, which flanks Fl exposed to the light rays, lie in planes, for example P1, P2, P3 and P4, parallel to the angle of inclination $\alpha$, as shown in FIG. 2. When these planes are placed perpendicular to the angle of incidence ASUN1 or ASUN2 as shown in FIG. 1, all the light is retroreflected, this being depicted in the form of double-headed arrows. As already mentioned, depending on the slat geometry, it is not necessary for the retroreflection to be truly ideally retroreflective (with reflection in the precise direction of incidence) and the reflected rays may be focused in any plane external to the screen (and to the right thereof). The slat flanks Fl', not intended to be exposed to the light rays, may be placed in parallel planes P'1, P'2, P'3 and P'4. For example, these parallel planes P'1, P'2, P'3 and P'4 may be approximately perpendicular to the planes P1, P2, P3 and P4.

However, to reflect the sun rays, it is unnecessary for the slats to be highly tilted, thereby maintaining high visibility to the outside.

According to the invention, the surfaces of the slat teeth are formed so that, when a slat is planar (before being curved), the angles of the flanks that will be exposed to the direct solar radiation to the mid-plane of the slat vary over the width of the slat. These flank angles are calculated so that the flanks exposed to the light all become approximately parallel when the slat is shaped, that is to say when a permanent curvature deformation is applied to it so as to give the slat the stiffness necessary for the installation.

Thus, for teeth produced in the actual thickness of the slat (and therefore the apex angle of which does not vary during the slat-shaping operation) the root angles $\beta c$ made by the flanks of two consecutive teeth vary over the width of the slats. These angles are not equal and the teeth flanks are formed so as to be not parallel when the slats have not yet been curved. When the slat is curved, to be installed in a venetian blind, the angles of the teeth flanks intended to be exposed to the direct solar radiation are corrected so as to be at least partly parallel to one another.

For teeth formed by folding a sheet, it is possible to calculate the angles so that, during the curvature shaping of the slat, the apex angles $\beta s$ and the root angles $\beta c$ of the teeth vary together, and thus ensure that the exposed flanks become parallel.

This structural shape has the advantage of being identical over the entire width of the slats of the installed venetian blind or at least over a portion exposed to the sun. The corrections in relation to the variations in the angle of the incident solar radiation are made by a motor drive preferably controlled by a solar incidence sensor. The documents of the prior art, intended to be adapted to any solar incidence situation, may prove not to be adapted under certain conditions. Of course, it is possible to adjust these slats of the prior art, but their structure, as it is optimized for a fixed given orientation, may involve situations for finely adjusting the orientation that are tricky to achieve.

When the teeth flanks exposed to the sun rays are parallel, they may all be placed perpendicular to the highest angle of incidence. Thus, the rays that reach the slats are reflected directly, back along the same direction of incidence, and there is no risk of parasitic reflections against the upper slat. The properties of the retroreflective slats are therefore exploited to the maximum, while still maintaining a blind structure in which the slats have a curved profile. Specifically, if the faces of the teeth D are positioned so as to be approximately perpendicular to the main direction of incidence, the slat itself remains approximately horizontal and permits optimum visibility.

The main direction of incidence of the sun rays, defining the tilt angle of the slats according to the invention, may be defined on the basis of measurements coming from one or more sensors, by geographical location calculation and/or by simple time-based operation.

Another clear advantage is the manufacture of these planar slats which are formed flat in a first step, and then curved in a second step. Simpler tools may be used to manufacture or treat the reflecting surface of the slats.

Depending on the curvature given to these slats subsequently, computing tools determine the angles of the various teeth flanks.

The angles between the flanks may be formed on a flat slat so as to be equal, for certain areas of the slat width only or to be equal in groups over the slat width. This is because, during the subsequent curving step, there will be very little deformation between two successive teeth or between a few successive teeth.

To apply the method of control according to the invention, the installation additionally includes a central processing unit CPU and a remote control unit RCU that can be activated by the user occupying the room and connected to an input IN of the central processing unit CPU. An output OUT of the central processing unit serves to activate the slat-tilting motor MOT in one or other direction. The details of the kinematic chain have not been shown. In particular, the central processing unit includes software means for controlling an operation of the installation according to the method forming the subject of the invention, one embodiment of which is described in detail below. In particular, these software means comprise computer programs.

In addition, the installation includes a sensor SR connected to the central processing unit via a link SRL. The sensor is used to generate in the central processing unit CPU at least two items of information about the state of the solar radiation. A first item of information PSUN relates to the presence of direct solar radiation on the glazing GLZ. A second item of information ASUN relates to the main direction of incidence (or height) of this direct solar radiation.

Alternatively, the central processing unit CPU includes an astronomical clock CLK. By this is meant a device giving the current height of the sun (equivalent to the angle of incidence ASUN) based on the solar time and date and comprising the computing means necessary for periodically determining the current value of a tilt threshold ATH i.e. the limiting tilt position of the slats in which the direct solar radiation is retroreflected by the slats, without affecting other slats. These computing means include a time-and-date variation law, which parameters (such as the latitude, the longitude, the angle of inclination of the blind to the vertical, the exposure of the blind to the cardinal points and the dimensions and spacings of the slats) may be defined at the moment of installation. For example, these parameters may be input via a man-machine interface of the installation. Or alternatively, some of these parameters may be automatically determined by the installation after an installer or a user has stored in memory, at a certain date, one or more particular tilt positions of the slats in which the direct solar radiation is reflected by the slats, without affecting other slats and without passing through the blind, or by reflections off the slats, or has stored in memory, at certain dates, one or more particular tilt positions of the slats in which the direct solar radiation is retroreflected by the slats, without affecting other slats.

By means of the remote control unit, the sensor SR and the astronomical clock CLK, the central processing unit CPU can thus control the positions of the slats in order to comply with automatic and/or manual operation.

In operation, the central processing unit CPU determines, from the data delivered by the sensor SR or the astronomical clock CLK, the position in which the slats have to be oriented in order to allow the light rays to be retroreflected. The orientation of the slats is servocontrolled to the angle of incidence so as to maintain a retroreflecting position whatever this angle of incidence.

The servocontrol may be defined by learning, or by the configuration of the installation, for example by inputting data relating to the slats (angle $\alpha$ of the useful teeth flanks (i.e. intended to be exposed to the direct solar radiation) with respect to the reference plane of the slat, as defined above).

The main servocontrol may be implemented in the presence of direct radiation. When direct radiation is absent, other, auxiliary servocontrols may be provided (for example a particular default tilt of the slats or complete occultation with maximum tilting of the slats) depending on very particular foreseen situations (overcast sky, absence of radiation, winter/summer operation, etc.).

Various slats, each having a given angle $\alpha$ to the reference plane, may be provided. The installer will thus choose the best-suited slat according to a maximum angle of opening of the slats for a given angle of incidence, for example according to the geographical location (latitude) and the location of the glazing to be shaded (high story of a building, in which case the preferential view is not necessarily horizontal but in a downward direction). By default, the angle $\alpha$ may be taken to be 45° to the reference plane of the slat.

Figure 3:
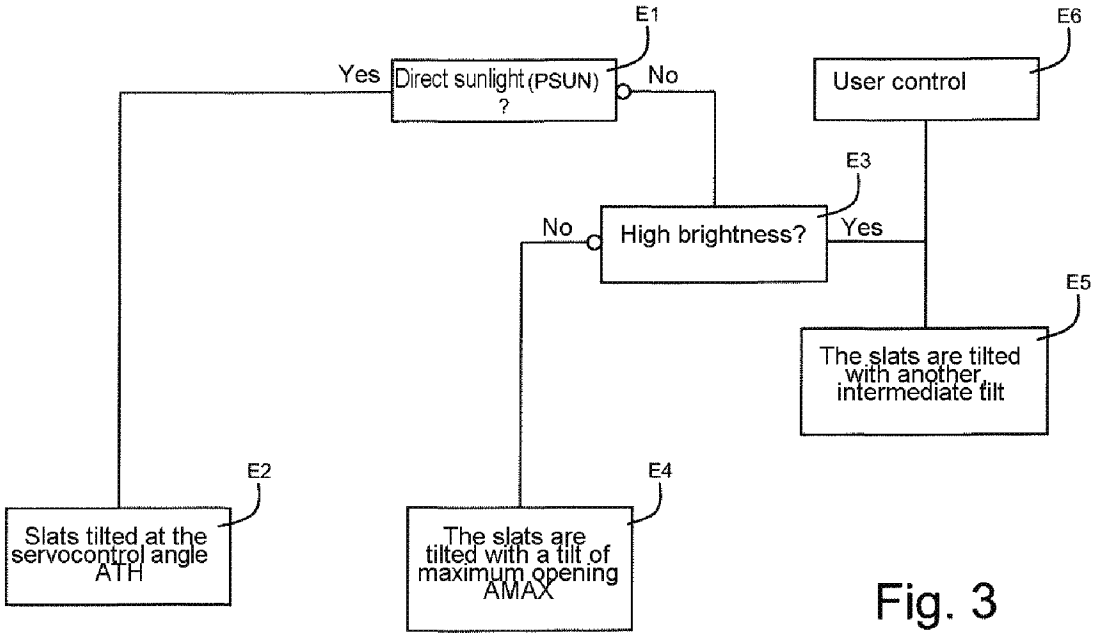
FIG. 3 is a block diagram for one way of carrying out a method of controlling the solar protection installation according to the invention.

The method of control according to the invention is described below with reference to FIG. 3.

In a first step E1, the presence of direct sunlight is tested. If the first item of information PSUN corresponds to the presence of direct sunlight on the glazing GLZ, the procedure then passes to a second step E2, otherwise it passes to a third step E3.

In the second step E2, the slats are tilted at the angle ATH (or servocontrolled threshold) defined by the servocontrol chosen.

During this second step E2, the central processing unit sends the signals to the motor that are necessary for orienting the slats with a tilt equal to the servocontrolled threshold ATH.

During the third step E3, reached when direct solar radiation is absent, the information item relating to sky brightness is tested. If the overall or local brightness is not considered to be high, the procedure passes to the fourth step E4 of orienting the slats with a first tilt of predefined maximum opening AMAX. This first tilt gives good vision of the outside through the slats. This tilt corresponds for example to the tilt of maximum opening of the slats relative to a preferred direction, i.e. a tilt position of the slats in which the slat areas projected in this preferred direction are minimal. If the overall or local brightness is considered to be high, or upon local control by a user during a step E6, the procedure then passes to a fifth step E5 in which the slats are oriented with a second tilt. This second tilt corresponds to a high-angle (close to 90°) tilt, at least such that the mean plane of the slats is approximately perpendicular to the direction of highest brightness of the sky. If the sky is uniformly lit (in what is called an "overcast" situation), then this second tilt is preferably an extreme tilt of the slats enabling the screen to be completely closed, or approaching this situation.

To simplify matters, the first and second tilts are predefined, either by the constructor or following a learning process.

In a more elaborate version, these values are determined by the sensor SR and the central processing unit CPU after analyzing the state of the sky and possible identification of a direction of higher brightness.

A specific user control, activated during a sixth step E6 on the remote control unit RCU, is used at any instant to activate the fifth step E5, in priority over the automated actions.

After steps E2, E4 and E5, the procedure returns, after a possible delay, to the first step E1 (the return loop has not been shown).

In the present application, the expression "at least approximately perpendicular" means "perpendicular or approximately perpendicular". Likewise, the expression "at least substantially about" means "about or substantially about".

The invention also relates to a process for manufacturing slats comprising the following steps:

shaping of longitudinal teeth formed by a succession of first and second flanks on one face of a slat, the slat lying generally in a plane; and curving of the slat, the toothed face of the slat being folded about an axis parallel to the longitudinal axis of the slat, in such a way that the first flanks are all at least approximately oriented parallel to one and the same plane.

The teeth-shaping step may include the formation of teeth having root angles βc that vary over the width of the slat.

In addition, the teeth-shaping step may include the formation of teeth having apex angles βs that vary over the width of the slat.

In addition, the teeth-shaping step may include the formation of at least one group of teeth having parallel flanks.

The invention claimed is:

1. A method for the automated control of a solar protection installation (INST), comprising:

reflecting slats (B1, B2, B3) the longitudinal axes of which are parallel, the slats having a face (F) provided with teeth (D), the teeth having flanks (Fl)that are reflective of incident light rays, called "useful" flanks, lie in parallel planes (P1, P2, P3, P4);

wherein the reflecting slats are shaped of longitudinal teeth formed by a succession of first and second flanks on one face of a slat, the slat lying generally in a plane; and are curved, the toothed face of the slat being folded about an axis parallel to the longitudinal axis of the slat, in such a way that the first flanks are all at least approximately oriented parallel to one and the same plane, wherein the profile of the reflecting slats is curved;

means (CPU, CLK, ASUN) for determining a main direction of incidence (ASUN1; ASUN2) of the light rays on the reflecting slats; and a motor (MOT) for tilting the reflecting slats at least substantially about their longitudinal axis, the method of control including a step of automatically tilting the reflecting slats so as to orient the planes of the useful flanks according to the main direction of incidence of the light rays, wherein the reflecting slats remain substantially horizontal.

2. The method of control as claimed in claim 1, wherein the useful flanks are oriented at least approximately perpendicular to the main direction of incidence.

3. The method of control as claimed in claim 2, wherein the means (CPU, CLK, ASUN) for determining a main direction of incidence (ASUN1; ASUN2) of the light rays on the slats comprise a sensor (SR) for measuring at least one parameter.

4. The method as claimed in claim 2, wherein the means (CPU, CLK, ASUN) for determining a main direction of incidence (ASUN1; ASUN2) of the light rays on the slats comprise an astronomical clock, in particular of the "sun-tracking" type, for determining the apparent position of the sun in the sky.

5. The method of control as claimed in claim 1, wherein the means (CPU, CLK, ASUN) for determining a main direction of incidence (ASUN1; ASUN2) of the light rays on the slats comprise a sensor (SR) for measuring at least one parameter.

6. The method as claimed in claim 1, wherein the means (CPU, CLK, ASUN) for determining a main direction of incidence (ASUN1; ASUN2) of the light rays on the slats comprise an astronomical clock, in particular of the 'sun-tracking' type, for determining the apparent position of the sun in the sky.

7. Motorized solar protection installation, comprising:

reflecting slats (B1, B2, B3) the longitudinal axes of which are parallel, the slats having a face (F) provided with teeth (D), the teeth having flanks (F1)that are reflective of incident light rays, called "useful" flanks, lie in parallel planes (P1, P2, P3, P4);

wherein the reflecting slats are produced by means of a process comprising the following steps:

shaping of longitudinal teeth formed by a succession of first and second flanks on one face of a slat, the slat lying generally in a plane; and curving of the slat, the toothed face of the slat being folded about an axis parallel to the longitudinal axis of the slat, in such a way that the first flanks are all at least approximately oriented parallel to one and the same plane, wherein the profile of the reflecting slats is curved;

means (CPU, CLK, ASUN) for determining a main direction of incidence (ASUN1; ASUN2) of the light rays on the reflecting slats; and a motor (MOT) for tilting the reflecting slats at least substantially about their longitudinal axis, which includes hardware means (CPU) and software for implementing the method of control as claimed in claim 1, wherein the reflecting slats remain substantially horizontal.

8. The installation as claimed in claim 7, wherein the teeth-shaping step includes the formation of teeth having root angles (βc) that vary over the width of the slat.

9. The installation as claimed in claim 8, wherein the teeth-shaping step includes the formation of teeth having apex angles (βs) that vary over the width of the slat.

10. The installation as claimed in claim 7, wherein the teeth-shaping step includes the formation of at least one group of teeth having parallel flanks.

11. A method for the automated control of a solar protection installation, comprising:

providing teeth on a face of a curved slat, the teeth having flanks that arc reflective of incident light rays, the flanks laying in parallel planes;

wherein the curved slats are produced by means of a process comprising the following steps:

shaping of longitudinal teeth formed by a succession of first and second flanks on one face of a slat, the slat lying generally in a plane; and curving of the slat, a toothed face of the slat being folded about an axis parallel to the longitudinal axis of the slat, in such a way that the first flanks are all at least approximately oriented parallel to one and the same plane, wherein the profile of the reflecting slats is curved;

determining a main angle of incident light rays on the slats; and rotating the curved slat based on the main angle of incident light so that planes of the flanks are substantially perpendicular to the angle of the incident light rays.

* * * * *